US006460986B2

(12) United States Patent
Sasaki

(10) Patent No.: US 6,460,986 B2
(45) Date of Patent: Oct. 8, 2002

(54) HEAD UNIT FOR AN INK JET PRINTER

(75) Inventor: Toshiyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 09/745,956

(22) Filed: Dec. 21, 2000

(65) Prior Publication Data

US 2001/0009434 A1 Jul. 26, 2001

(30) Foreign Application Priority Data

Jan. 26, 2000 (JP) ..... 2000-017615
Jan. 26, 2000 (JP) ..... 2000-017616

(51) Int. Cl.[7] ..... B41J 2/17
(52) U.S. Cl. ..... 347/94
(58) Field of Search ..... 347/84, 85, 86, 347/87, 94

(56) References Cited

U.S. PATENT DOCUMENTS

| | | | | |
|---|---|---|---|---|
| 5,877,794 A | | 3/1999 | Takagi | 347/87 |
| 5,971,529 A | | 10/1999 | Pawlowski, Jr. et al. | 347/86 |
| 5,992,992 A | * | 11/1999 | Gibson | 347/94 |
| 6,017,118 A | | 1/2000 | Gasvoda et al. | 347/86 |
| 6,203,147 B1 | | 3/2001 | Battey et al. | 347/86 |
| 6,244,698 B1 | * | 6/2001 | Chino et al. | 347/94 |

FOREIGN PATENT DOCUMENTS

| | | |
|---|---|---|
| DE | 197 48 914 | 8/1998 |
| DE | 199 04 804 | 8/1999 |
| EP | 0 496 620 | 7/1992 |
| EP | 0 779 157 | 6/1997 |
| EP | 0 891 866 | 1/1999 |
| JP | 02-150354 | 6/1990 |
| JP | 06 210864 | 8/1994 |
| JP | 10-128999 | 5/1998 |
| JP | 10-329340 | 12/1998 |
| JP | 11-070666 | 3/1999 |

* cited by examiner

*Primary Examiner*—Anh T. N. Vo
(74) *Attorney, Agent, or Firm*—Michael T. Gabrik

(57) ABSTRACT

The ink outlet of a pressure damper connects reliably to the ink supply inlet of an ink-jet print head even if there are dimensional variations in the molded parts of the print head unit. A print head unit 10 includes an ink-jet print head 12 with an ink supply inlet 14; a carriage 11 for holding the ink-jet head 12; a pressure damper 21 for absorbing pressure variation in the ink supplied to the ink-jet print head; and a case 20 for housing the pressure damper 21. The pressure damper 21 is supported inside case 20 in the connect/disconnect direction of the ink outlet 22 to the ink supply inlet 14. A spring 31 pushes against the pressure damper 21 so that the ink outlet 22 is press fit to ink supply inlet 14.

54 Claims, 8 Drawing Sheets

HEAD UNIT FOR AN INK JET PRINTER

BACKGROUND OF THE INVENTION

1. Field of the Invention

The present invention relates to a print head unit having an ink-jet print head, and relates more particularly to a mounting construction for a pressure damper that absorbs pressure variation in the ink inside the ink-jet print head.

2. Description of the Related Art

Ink-jet printers are widely and commonly used today as continuing improvements in ink-jet print head molding technology and ink discharge control technology have made it possible to freely control the placement of minute ink drops on recording media and achieve extremely high quality printing at high speed.

The surface condition of each ink nozzle is extremely important if stable printing results are to be achieved in an ink-jet printer; in other words it is necessary that ink forms an appropriate meniscus in each ink nozzle during printing. To achieve this, the pressure inside the path through which ink is supplied to the ink-jet print head, and, within the ink-jet head, to the ink nozzles must be kept constant. Ink stored in the ink tank travels through a flexible tube to the ink-jet print head. The ink-jet print head prints while the print head unit equipped with the ink-jet print head and a carriage is being moved according to a printing control command. As a result, the shape of the bend, that is, the curvature, of the tube whereby ink is supplied to the ink-jet print head changes as the print head unit moves. This destabilizes the ink pressure in the ink-jet print head, and creates the danger of the meniscus desirably formed in an ink nozzle being destroyed.

Some ink-jet printers are equipped with a pressure damper directly connected to the ink-jet print head to avoid this problem. The pressure damper typically has an ink reservoir that freely expands and contracts, and thus has a variable capacity. Ink supplied through the ink tube is temporarily stored in this ink reservoir, and the ink pressure inside the ink-jet print head is thereby held constant.

The substrate on which this ink-jet print head is mounted is normally fastened directly to the carriage in this type of printer. The pressure damper is fixed inside a particular case, and connection of the pressure damper to the ink-jet print head is assured by fastening the case to the carriage.

In other words, the ink outlet of the pressure damper is insertion fit to the ink supply inlet of the ink-jet print head when this case is fastened to the carriage, and a seal therebetween is thus held.

However, problems such as the following remain in a conventional ink-jet printer equipped with a pressure damper.

(1) Molding variations in the case, carriage, and pressure damper mean that even when the case is completely fastened to the carriage, the ink outlet of the pressure damper may not be completely connected to the ink supply inlet of the ink-jet print head. More specifically, dimensional tolerance caused by molding variations can create a gap or inclination between the bonding surfaces of the ink supply inlet and ink outlet, thus degrading the seal.

(2) External force acting on the case in which the pressure damper is housed is transferred directly to the pressure damper inside the case. This can adversely affect the connection between the ink supply inlet and ink outlet.

While the ink outlet of the pressure damper and the ink supply inlet of the ink-jet print head could be connected by an adhesive, for instance, to ensure a reliable connection, this would make it more difficult to replace or repair individual parts. It would become particularly difficult to install and remove individual pressure dampers to the ink-jet print head in a print head unit having plural ink-jet print heads each connected to a respective one of pressure dampers arranged next to one another.

Furthermore, a pressure damper must be provided for each of the colors used in color printers that use plural colors of ink. This increases the size of the print head unit. It is therefore desirable to make the print head unit as small as possible, particularly when plural pressure dampers are present.

OBJECTS OF THE INVENTION

Therefore, it is an object of the present invention to overcome the aforementioned problems by providing a print head unit that reliably connects the ink outlet of the pressure damper to the ink supply inlet of the ink-jet print head.

It is a further object of the invention to minimize the effect on the pressure damper of external force applied to the case housing the pressure damper, and thus prevent any such external force from affecting the connection between the ink supply inlet and ink outlet.

Yet a further object of the invention is to reduce the size of the print head unit.

SUMMARY OF THE INVENTION

To achieve these objects, a print head unit, according to one aspect of the present invention, is provided. The print head unit comprises an ink-jet print head having an ink supply inlet, a first support member (preferably a carriage) in which the ink-jet print head is formed, a pressure damper for absorbing pressure variation in the ink in the ink-jet print head, and a second support member (preferably a case) that is removably connectable to the first support member and supports (houses) the pressure damper. The pressure damper has an ink outlet that is removably connectable to the ink supply inlet, and the second support member supports the pressure damper movably in the connect/disconnect direction of the ink outlet to the ink supply inlet. In addition, the print head unit further includes a biasing element for pushing the ink outlet of the pressure damper to the ink supply inlet.

Thus comprised, the ink outlet can be reliably connected to the ink supply inlet, even if there are molding variations in the cases and/or pressure damper because the biasing element pushes the pressure damper to the ink-jet print head.

The pressure damper further preferably has a seat at a back part of the ink outlet, and the biasing element pushes against the seat.

Yet further preferably, the biasing element is a spring extending between the seat and an inner wall of the second support member.

Yet further preferably, the second support member has a guide for limiting movement of the pressure damper in a direction other than the connect/disconnect direction.

Yet further preferably, an opening for exposing the ink outlet of the pressure damper is provided in the bottom wall of the second support member, and an opening for exposing part of the top of the pressure damper is provided in the top wall of the second support member.

Yet further preferably, the pressure damper further comprises a pin protruding externally from the opening provided in the top wall of the second support member. Thus, when the force of the biasing element alone is not enough to connect the pressure damper and ink-jet print head, this pin can be depressed to push ink outlet to ink supply inlet, and thereby positively press fit ink supply inlet into ink outlet.

Yet further preferably, the first support member holds a plurality of ink-jet print heads, and the second support member supports a plurality of pressure dampers, one corresponding to each of the ink-jet print heads. In this case the pressure damper preferably has a circumferential surface between two parallel sides, and the ink supply inlet, ink outlet, and pin are formed on the circumferential surface. The size of a print head unit having a plurality of ink-jet print heads can thus be reduced.

The above-described print head unit may be part of a printing mechanism embodied in a printer, such as an ink-jet printer.

In another aspect, the invention may be embodied in a method of making a print head unit, such as the one described above.

Other objects and attainments together with a fuller understanding of the invention will become apparent and appreciated by referring to the following description and claims taken in conjunction with the accompanying drawings.

BRIEF DESCRIPTION OF THE DRAWING

In the drawings wherein like reference symbols refer to like parts.

KEY TO THE FIGURES

Figure 1:
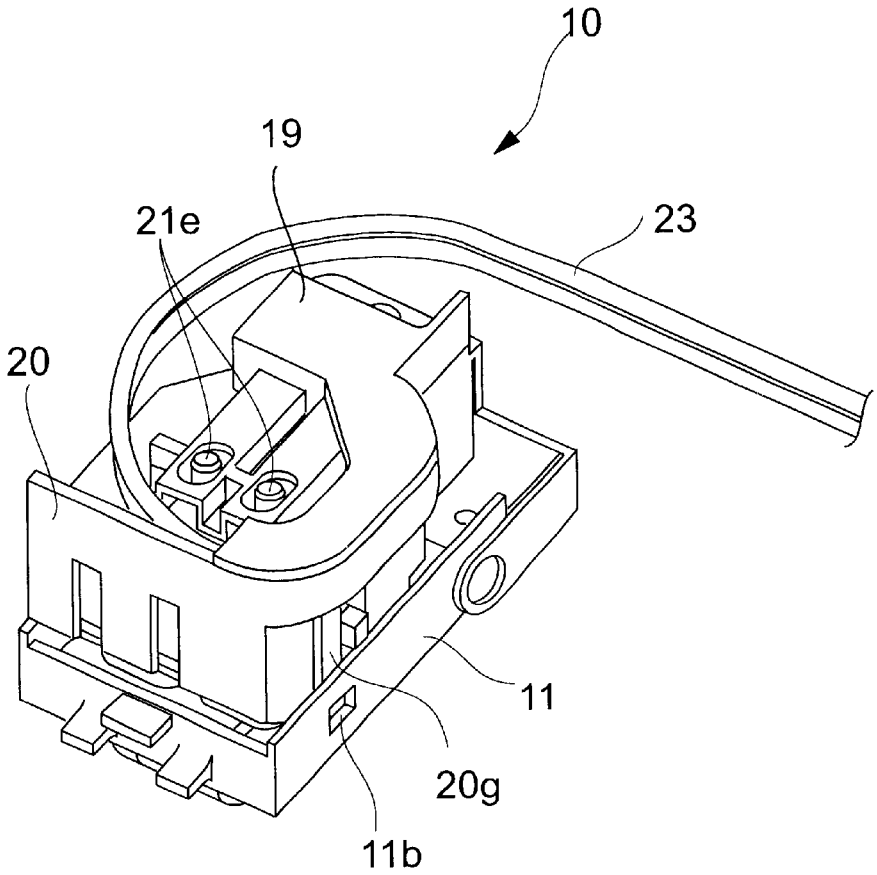
FIG. 1 is an oblique view of a print head unit according to a preferred embodiment of the invention.

10 print head unit
11 carriage
11*a* opening
11*b* holes
11*c* screw hole
12 ink-jet head
13 printed circuit board
14 ink supply inlet
19 ink supply unit
20 case
20*a* main case
20*b* through-hole
20*c* tubular guide
20*d* cover case
20*e* long hole
20*f* pin
20*g* pair of claws
21 pressure damper
21*a* pressure absorption chamber
21*b* back
21*c* seat
21*d* pin
21*e* guide pin
22 ink outlet
22*a* passage
23 ink tube
24 O-ring
25 retainer
31 spring
S housing space

DESCRIPTION OF THE PREFERRED EMBODIMENTS

Figure 2:
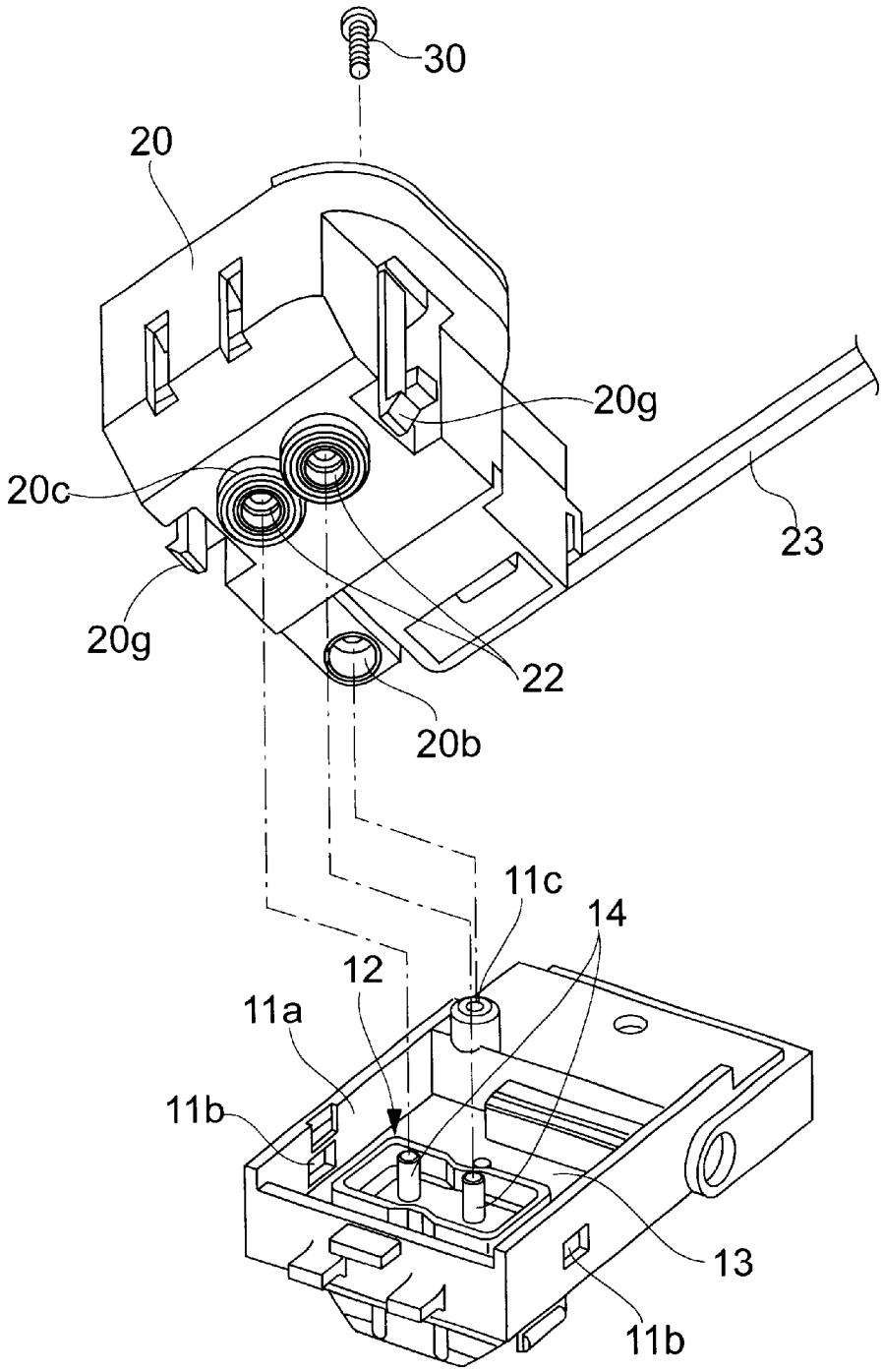
FIG. 2 is a partially exploded oblique view of the print head unit shown in FIG. 1.
Figure 8:
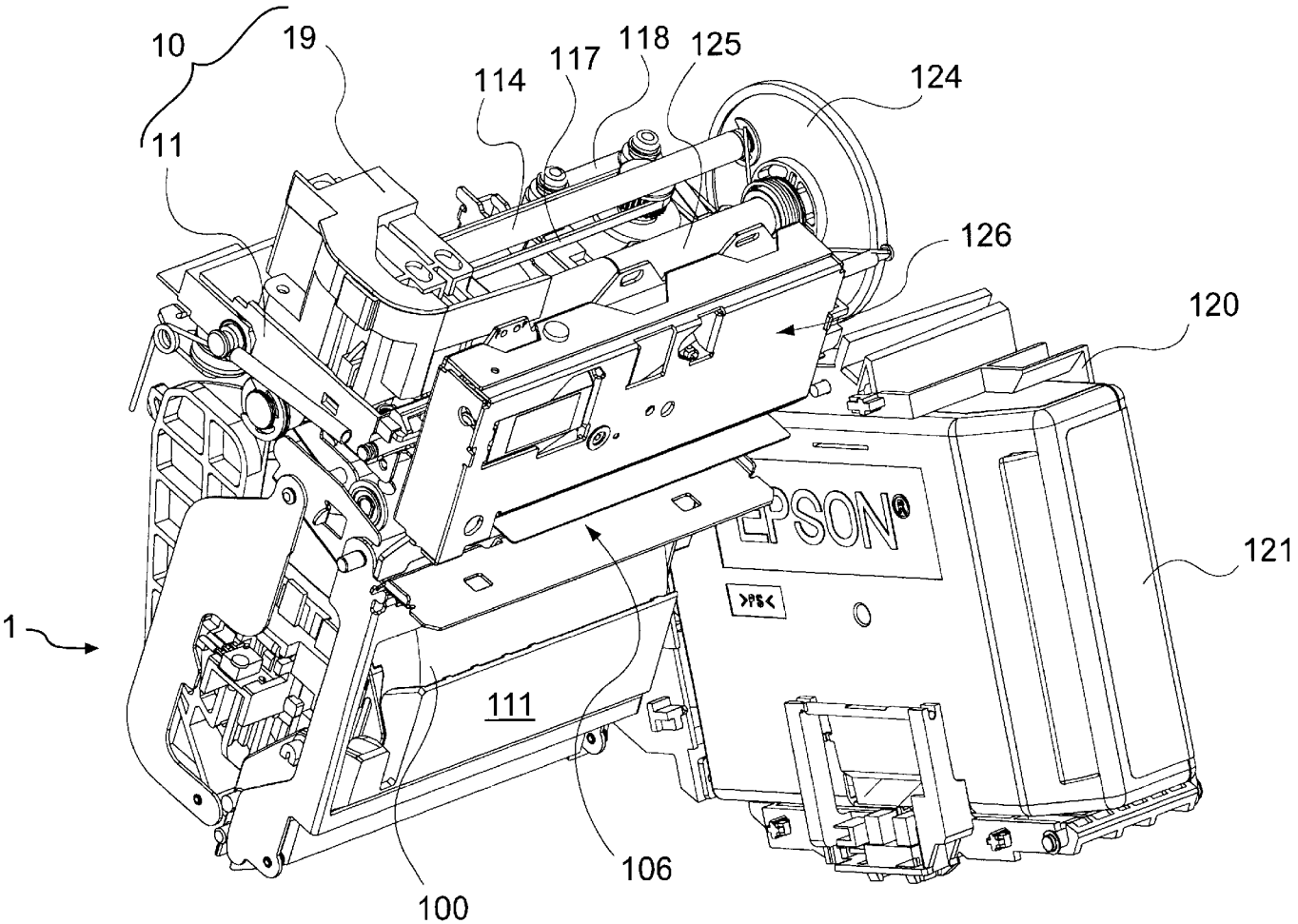
FIG. 8 is an oblique view of a printer equipped with the print head unit shown in FIG. 1.

The preferred embodiments of the present invention are described below with reference to the accompanying figures. FIG. 1 is an oblique view of a print head unit according to a preferred embodiment of the invention, and FIG. 2 is a partially exploded oblique view of the same. FIG. 8 is an oblique view of a printer equipped with the print head unit shown in FIG. 1.

Referring to FIG. 8, a roll paper printer 1 according to this preferred embodiment has a paper transportation roller 125 for transporting the printing paper used as the print medium from a paper roll 100 held in roll paper housing 111. The printing medium used in printer 1 is not critical to the present invention and paper is to be understood only as a representative of a variety of printing media that could be employed instead.

Drive power from a paper transportation motor (not shown in the figure) is transferred by way of intervening gear 124 to paper transportation roller 125. The ink-jet head 12 (shown in FIG. 2) is disposed above the paper with the ink nozzles facing down so that it can print to the surface of the paper as paper transportation roller 125 advances the paper toward the paper exit 106.

Printer 1 of the present embodiment is a two-color printer. Thus, the nozzle surface of print head 12 has two nozzle areas for discharging ink of two different colors, such as red and black. The number of colors is not critical to the present inventions, i.e., the principle of the invention is applicable to single-color printers as well as multi-color printers.

The ink-jet head 12 is mounted on a carriage 11, which travels bidirectionally along a guide rail 114 disposed widthwise to the printer. The carriage 11 is connected to a timing belt 117 mounted widthwise to the printer. The timing belt 117 is driven by a carriage motor 118. Note that an automatic paper cutter 126 for automatically cutting the printed paper is disposed directly above paper exit 106 for automatically cutting the paper to a specific length after printing is completed.

An ink supply unit 19 is also mounted on carriage 11. Carriage 11, inkjet head 12 and ink supply unit 19 are together referred to as print head unit 10 in this text.

Two kinds of ink of different colors are supplied, each by means of a respective flexible ink tube 23, from an ink cartridge 121 to a respective one of two pressure dampers 21 (shown in FIGS. 3 to 5) contained in ink supply unit 19. Each pressure damper 21 has a variable capacity, and is provided for absorbing pressure variations applied to ink in the inkjet head, or avoiding pressure variations to occur in the inkjet head. While it can be referred to as "pressure buffer" or "pressure compensator" other than "pressure damper", it will be referred to as "pressure damper" in this text.

The ink cartridge 121 is removably mounted to cartridge holder 120 and contains two ink bags (not shown in the figure) for storing two kinds of ink.

As shown in FIGS. 1 and 2, the ink-jet head 12 is mounted on a printed circuit board 13. Printed circuit board 13 is secured with screws, for example, inside opening 11*a* of carriage 11. When the ink-jet head 12 is fastened to carriage 11, the nozzle surface thereof is exposed from the bottom of carriage 11. An ink-jet head 12 according to this preferred embodiment of the invention has on the nozzle surface thereof two nozzle areas for discharging two different colors of ink, such as red and black. It therefore also has two ink supply inlets 14, one for each color, disposed to the top of the ink-jet head 12. An ink outlet 22*a* of each pressure damper 21 in ink supply unit 19 is connected to a corresponding ink supply inlet 14. Ink stored in the ink bags is thus supplied to the corresponding nozzle area of ink-jet head 12 by way of the intervening ink tube 23 and pressure dampers 21.

In the illustrated embodiment, ink supply unit 19 has case 20 that houses two pressure dampers 21, and holds them at the top of carriage 11 connected to ink-jet head 12. A pair of claws 20*g* is provided on two opposite sides of case 20. The claws 20*g* engage matching holes 11*b* formed in the corresponding ones of side walls defining opening 11*a* of carriage 11. A through-hole 20*b* for a screw is formed in a rear part of case 20. A screw 30 is inserted into through-hole 20*b* and threaded into a matching screw hole 11*c* formed at a corresponding position in the rear part of carriage 11 to fasten case 20 to carriage 11. Instead of the holes 11*b* corresponding holes could alternatively be provided in the ink-jet head and the claws 20*g* made to engage the holes in the ink-jet head.

As shown in FIG. 2, ink outlets 22 of the pressure dampers are exposed at the bottom of case 20. That is, holes surrounded by tubular guides 20*c* are formed in the bottom of case 20, and the ends of ink outlets 22 are exposed with the outside of the ink outlets 22 guided by the tubular guides 20*c*. When case 20 is fastened to carriage 11, each ink outlet 22 is thus connected to the corresponding ink supply inlet 14 of ink-jet head 12.

Figure 3C:
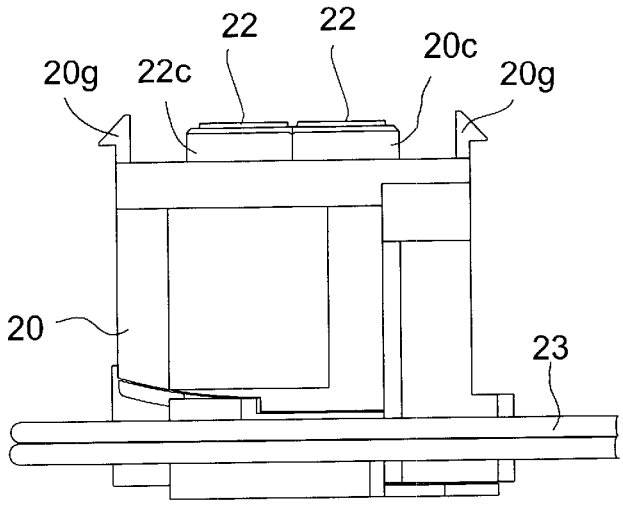
FIG. 3C is a side view of a print head unit according to the present invention.
Figure 3B:
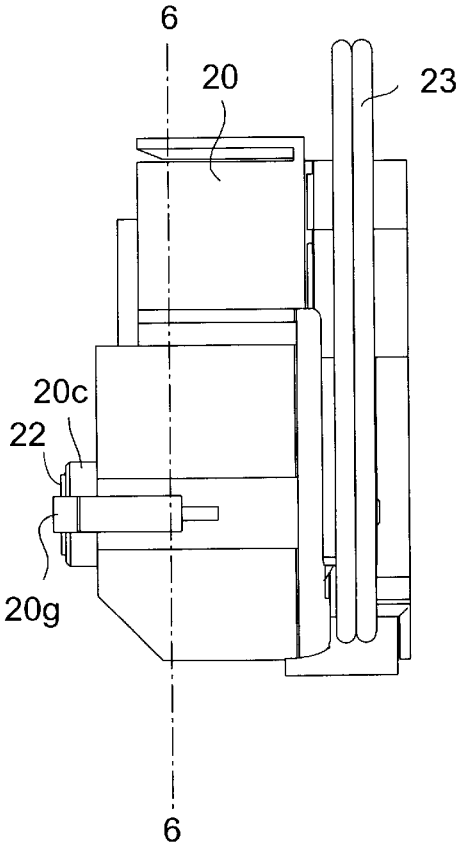
FIG. 3B is an end view of a print head unit according to the present invention.
Figure 3A:
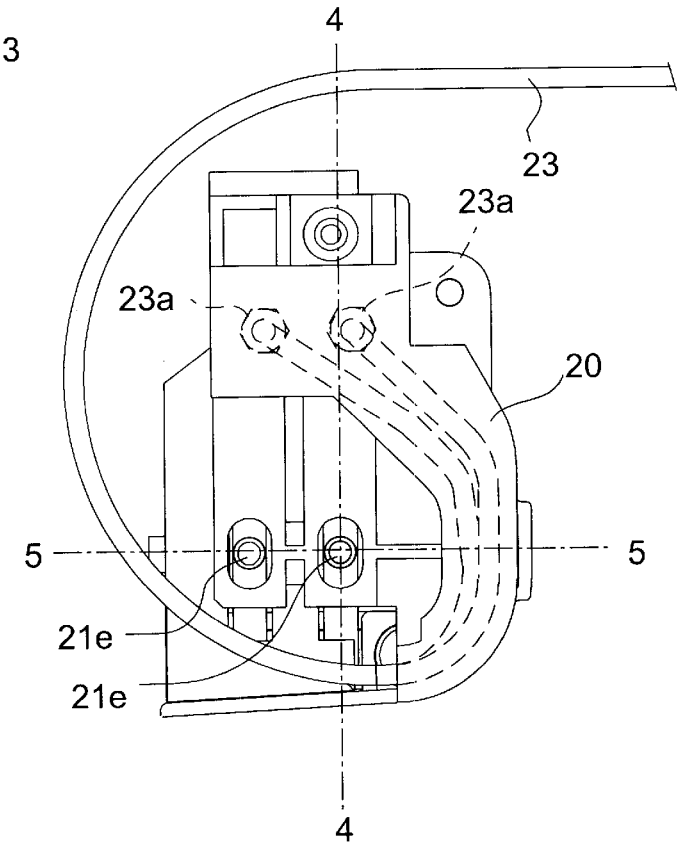
FIG. 3A is a top section view of a print head unit according to the present invention.
Figure 4:
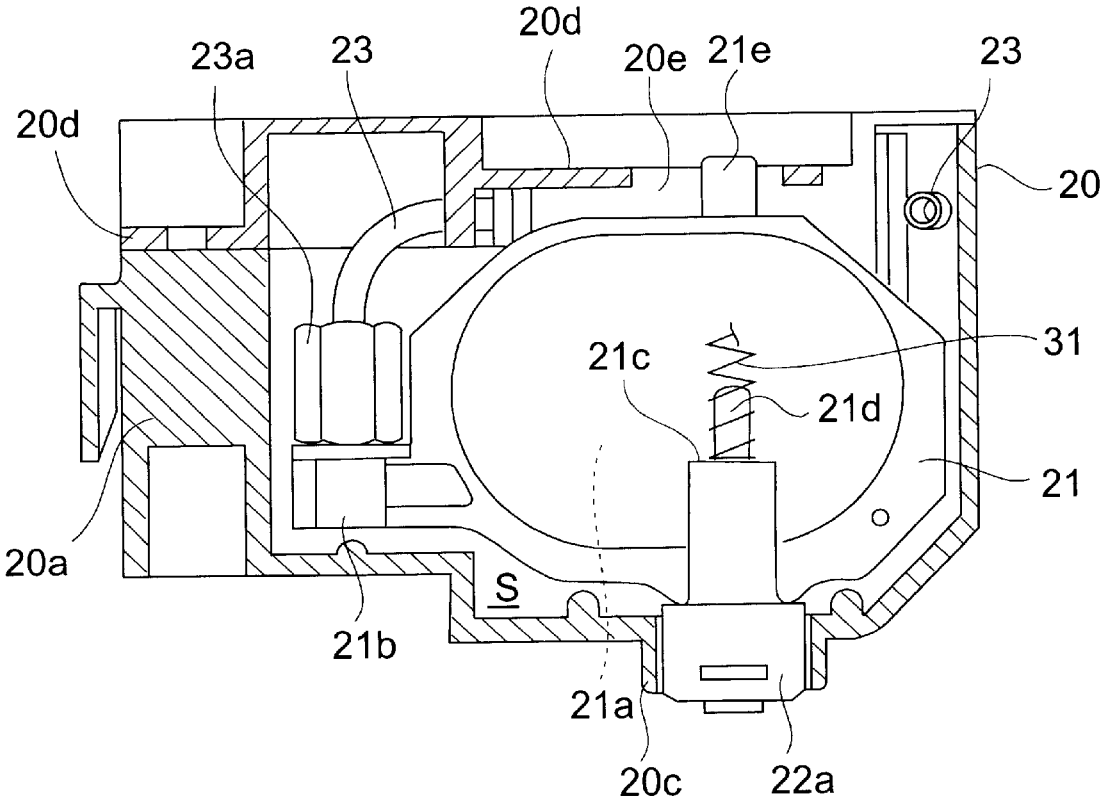
FIG. 4 is a vertical section view of the case with the pressure damper housed therein taken along line 4—4 in FIG. 3A according to the present invention.
Figure 5:
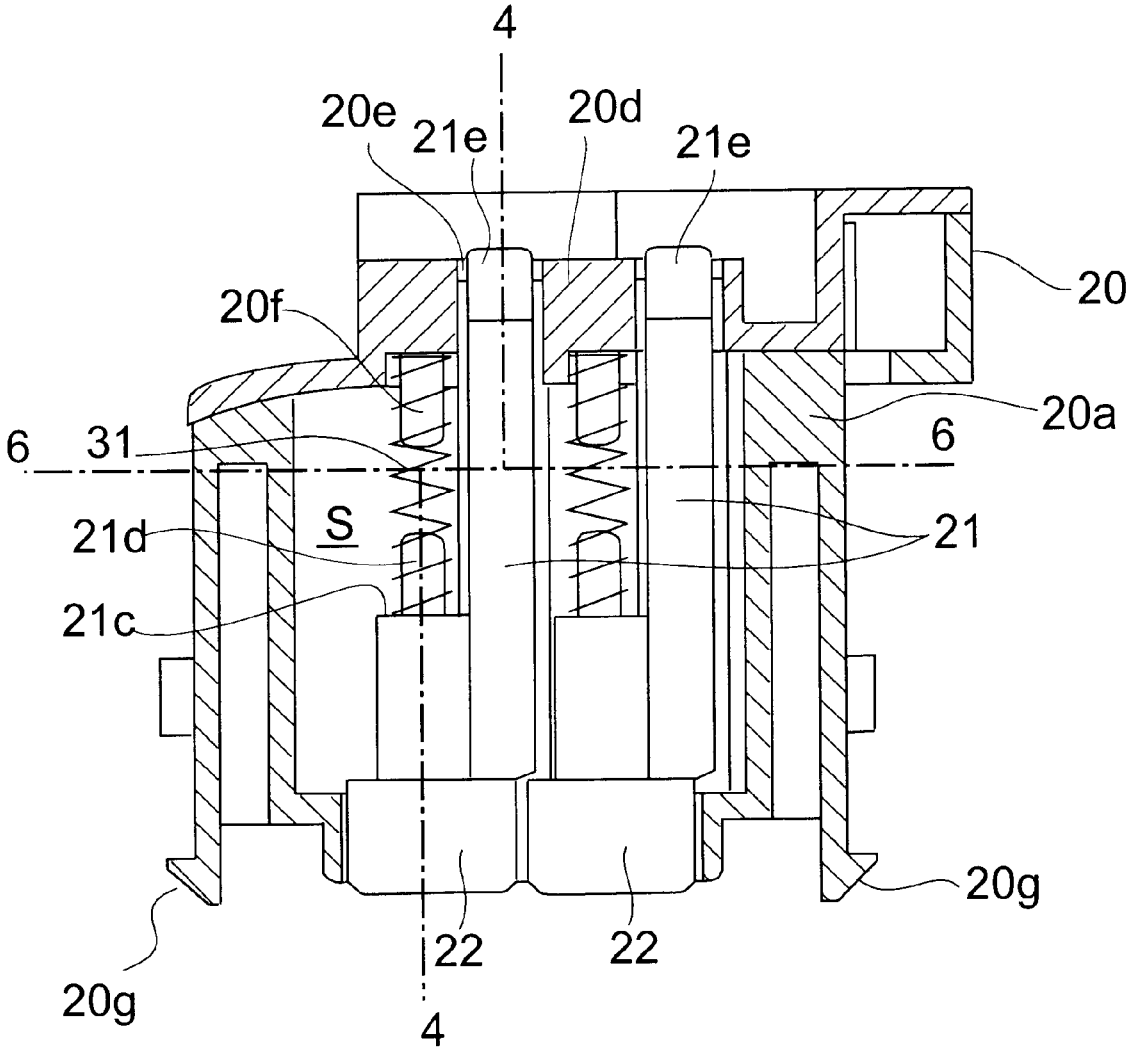
FIG. 5 is a lateral section view of the case with the pressure damper housed therein taken along line 5—5 in FIG. 3A according to the present invention.
Figure 6:
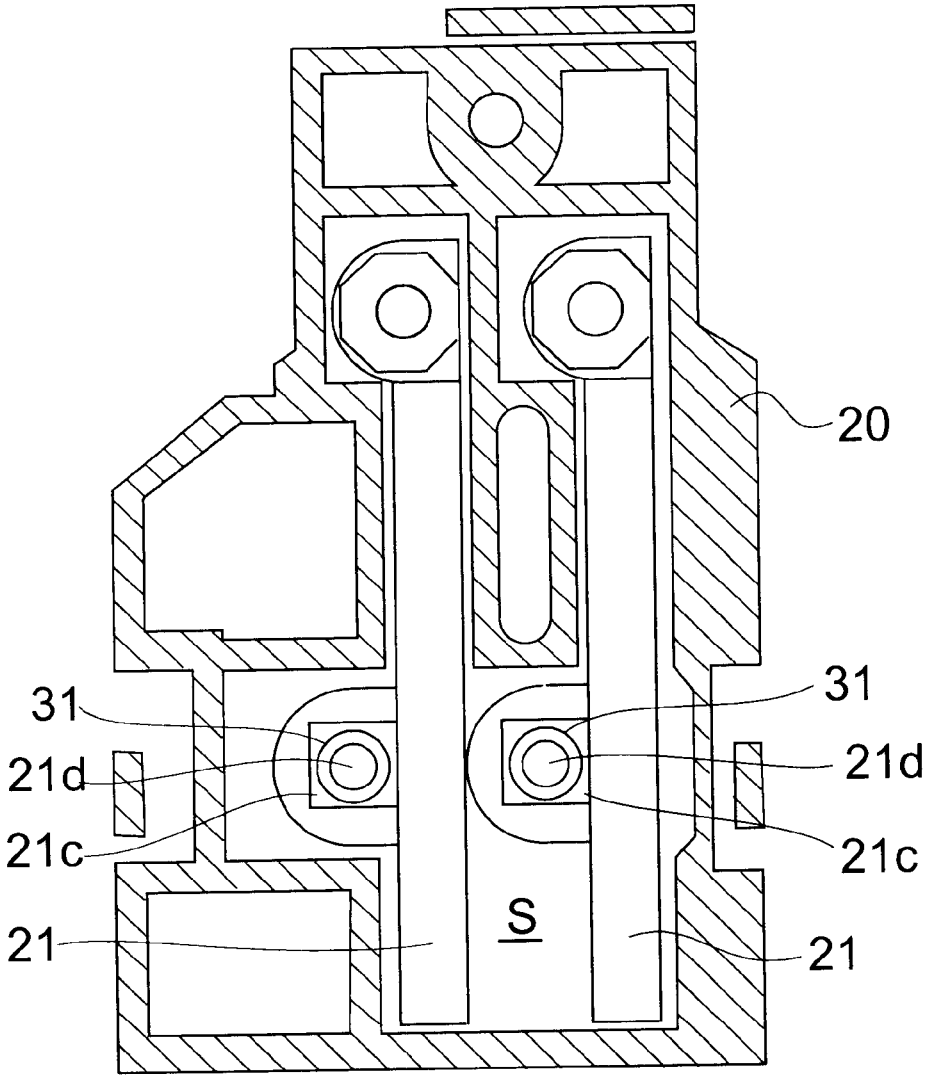
FIG. 6 is a plan section view of the case with the pressure damper housed therein taken along line 6—6 in FIG. 3B according to the present invention.

The support structure of each pressure damper 21 in case 20 is described next below with reference to FIGS. 3–6. FIGS. 3A, 3B and 3C illustrate top, end and side views, respectively, of print head unit 10, while FIGS. 4, 5 and 6 are vertical, horizontal, and plan section views, respectively, of case 20 with pressure dampers 21 housed inside. Note that FIG. 4 comprises two different sectional planes in the upper and lower part, respectively. Lines 4—4 in FIGS. 3A and 5 illustrate the sectional planes of FIG. 4. Also note that each of FIGS. 4, 5 and 6 show the two pressure dampers 21 housed in case 20.

Case 20 comprises a main case 20*a* and a cover 20*d*. Each pressure damper 21 has a thin plate-like main body of a basically elliptical shape. A cavity is formed inside the main body between a first and a second basically elliptical side wall and a peripheral wall. The second side wall (the one on the back side, not visible in FIG. 3) is formed by a thin flexible film. The cavity, thus, constitutes a chamber 21*a* for absorbing or compensating ink pressure variations.

A pipe coupling, to which the respective ink tube 23 extending from ink cartridge 121 is connected, is formed on the protruding back 21*b* at one longitudinal end (left end in FIG. 4) of the main body. Ink is supplied through ink tube 23 to pressure absorption chamber 21*a* via a channel connecting the pipe coupling with the chamber 21*a*.

An outlet portion 22 is formed on the outside of the first side wall and extends below the lower end of the main body. A lower tubular part of the outlet portion 22 extends partly from the peripheral wall of the main body and forms an ink outlet 22*a*; it is designed to fit into the respective tubular guide 20*c* at the bottom of main case 20*a*. The pressure absorption chamber 21*a* communicates with ink outlet 22*a*, and ink inside pressure absorption chamber 21*a* is supplied therefrom to ink-jet head 12. Pressure damper 21 also has a seat 21*c* for a coil spring 31, further described below, formed on the back of ink outlet 22 (the top as seen in FIG. 4). A pin 21*d* for guiding the spring 31 projects from seat 21*c*, and one end of spring 31 fits over the pin 21*d*.

A guide pin 21*e* is formed on the top of the main body of each pressure damper 21. This guide pin 21*e* is exposed outside of case 20 from long hole 20*e* formed in cover 20*d* of case 20 between main case 20*a* and cover 20*d*. When pressure damper ink outlet 22 is connected to ink supply inlet 14 of ink-jet head 12, the user depresses this guide pin 21*e*, which fits into long hole 20*e* and thereby helps assure a reliable connection.

Each pressure damper 21 is contained in a housing space S formed inside case 20 between main case 20*a* and cover 20*d*. As shown in FIG. 6, housing space S limits lateral movement of pressure damper 21. As shown in FIGS. 4 and 5, there is also a space above the pressure damper 21 when it is housed in housing space S, thereby allowing the pressure damper 21 to move vertically within the housing space S.

The spring 31 for each pressure damper 21 is also contained in the housing space S. Spring 31 urges the pressure damper 21 downward, which as noted above can move up and down within the housing space S. Each spring 31 is disposed between pin 21*d* formed on pressure damper seat 21*c*, and pin 20*f* formed on case cover 20*d*. Before case 20 is mounted on carriage 11, spring 31 pushes pressure damper 21 against the bottom inside wall of the main case 20*a*. Once case 20 is fixed to carriage 11, pressure damper 21 is lifted slightly in resistance to the force of spring 31, thus forming a slight gap to the bottom inside wall of the main case (see FIG. 4). Thus positioned, a complete, positive connection is assured between the ink supply inlet 14 of the ink-jet print head and the ink outlet 22 of the pressure damper as more fully described below, and this connection is maintained by the force of spring 31.

It should be noted that ink tube 23 is connected to the pipe coupling on back 21*b* of pressure damper 21 in this exemplary embodiment of our invention. When pressure damper 21 connects to ink-jet head 12, force acts from below to push pressure damper 21 upward at the ink outlet 22 disposed toward the front of pressure damper 21. At the same time, the connected ink tube 23 applies an opposing force at the back of pressure damper 21 resisting the upward movement of pressure damper 21. These opposite forces acting at the front and back of pressure damper 21 apply a counterclockwise moment to the pressure damper 21 as viewed in FIG. 4.

Note that while guide pin 21*e* moves slightly to the back at this time, long hole 20*e* in case 20 is sized to prevent contact with the guide pin 21*e* when it moves.

Figure 7:
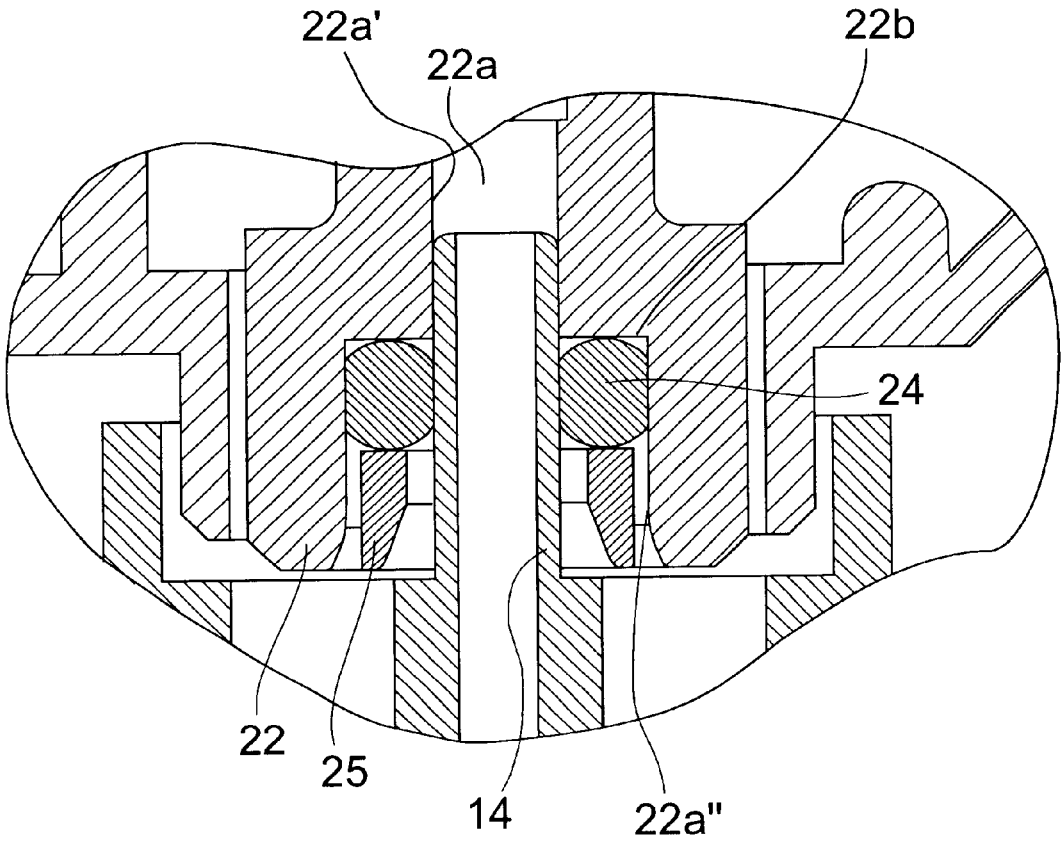
FIG. 7 is a section view of the structure according to the present invention for connecting the ink-jet print head and pressure damper.

A connecting structure for the ink-jet head 12 and pressure damper 21 is described next. This connecting structure is shown in section in FIG. 7. As shown in FIG. 7, ink outlet 22 of pressure damper 21 is a tubular member having a passage 22*a* communicating with pressure absorption chamber 21*a*.

Passage 22*a* has a smaller diameter section 22*a*' toward chamber 21*a* and a larger diameter section 22*a*" toward the outlet opening. A shoulder 22*b* is formed at the transition between sections 22*a*' and 22*a*". A rubber O-ring 24 is held against this shoulder 22*b* by a retainer 25 provided to hold O-ring 24 in position. O-ring 24 has an inner diameter smaller than that of passage section 22*a*'. As shown in this figure, an portion of ink supply inlet 14 of ink-jet head 12 is press fit into section 22*a*' of ink outlet passage 22*a*. More specifically, the outer diameter of ink supply inlet 14 is slightly smaller than the inner diameter of passage section 22*a*', and slightly larger than the inner diameter of O-ring 24. This difference in diameters means that when ink supply inlet 14 is press fit into the passage 22*a*, the end of ink supply inlet 14 pushes out on the inside of O-ring 24, and O-ring 24 forms a tight seal around ink supply inlet 14.

The action of the present invention is described next in conjunction with the procedure for connecting pressure damper 21 to ink-jet head 12 according to this preferred embodiment. Connecting pressure damper 21 to ink-jet head 12 is accomplished by fixing case 20 to carriage 11 as noted above. Each of the pressure dampers 21 is thus urged downward inside case 20 by a corresponding spring 31. Held as shown in FIG. 2, case 20 is positioned to carriage 11, and the claws 20*g* thereof are then engaged with holes 11*b* in the side of carriage 11. A screw 30 is then passed through through-hole 20*b* in case 20 and screwed into screw hole 11*c* in carriage 11, thereby fastening case 20 to carriage 11.

Thus assembled, ink supply inlet 14 of ink-jet head 12 is press fit inside ink outlet 22 of pressure damper 21 as shown in FIG. 7, and ink supply inlet 14 and ink outlet 22 are thus reliably connected. It should be noted that at this time pressure damper 21 is not fixed to case 20, which is fastened to carriage 11, and is pushed relative to case 20, toward ink-jet head 12 by the force of spring 31.

As shown in FIGS. 3 and 4, guide pin 21*e* on the top of pressure damper 21 protrudes to the outside of case 20 from long hole 20*e* formed in cover 20*d* of case 20. The user can therefore push down on the top of guide pin 21*e* so as to press ink outlet 22 to ink supply inlet 14 if the connection between pressure damper 21 and ink-jet head 12 established by the force of spring 31 is not sufficient. It is therefore possible to positively press fit ink supply inlet 14 into ink outlet 22, and thereby assure an even more reliable connection between ink supply inlet 14 and ink outlet 22.

If dimensional tolerance is relatively large when these components are molded, and the mounting height of the case 20 to the carriage 11 thus varies, the tolerance can be absorbed by movement of the pressure damper 21 within the case 20, and a reliable connection between ink-jet head 12 and pressure damper 21 can be assured. Furthermore, if an undesirable external force acts on case 20 when mounted to carriage 11, the effect of such external force is not easily transferred to the pressure damper 21 because the pressure damper 21 is not directly fastened to the case. More specifically, such undesirable external force is prevented from propagating to the ink inside the ink-jet print head, and more particularly to the meniscus formed in the nozzles from which ink drops are discharged.

Furthermore, force greatly exceeding the urging force of spring 31 is not applied to the connection between ink-jet head 12 and pressure damper 21 when case 20 is mounted to carriage 11, and damage to the connection can thus be prevented.

Yet further, protruding back 21*b* for connecting tube 23, ink outlet 22, and guide pin 21*e* are formed on or immediately next to the circumferential surface of pressure damper 21 in this preferred embodiment of our invention. In addition, tube retainer 23*a* is formed in line with the outside surface of pressure damper 21 so that ink tube 23 leads along the surface of pressure damper 21. This makes it possible to house plural pressure dampers 21 side-by-side in case 20 with the smallest possible gap therebetween, thus helping to downsize the print head unit 10.

Although the present invention has been described in connection with preferred embodiments thereof with reference to the accompanying drawings, various changes and modifications are possible. For example, while spring 31 is used to push pressure damper 21 to the ink-jet head 12 in the present embodiment, various other types of biasing elements or urging means, such as a leaf spring, can be alternatively used.

Furthermore, while an exemplary connecting structure for ink outlet 22 and ink supply inlet 14 is shown in FIG. 7, the invention shall not be so limited and other connecting structures will be obvious to one with ordinary skill in the related art.

Yet further, the present invention has been described with two pressure dampers 21 housed inside case 20, but it will also be obvious that our invention can be easily adapted for used with a print head unit having only one or some other plurality of pressure dampers.

As described above, this invention makes it possible to reliably and easily connect the ink outlet of a pressure damper to the ink supply inlet of a ink-jet print head in a print head unit regardless of any dimensional tolerance in any of the molded parts.

Furthermore, the connecting structure of the ink supply inlet and ink outlet reduces the effect on the pressure damper of external force applied to the case in which the pressure damper is housed. As a result, the effect of such external force on the connection between ink supply inlet and ink outlet is also reduced.

While the invention has been described in conjunction with several specific embodiments, many further alternatives, modifications, applications and variations, including those described above, will be apparent to those skilled in the art in light of the foregoing description. Thus, the invention described herein is intended to embrace all such alternatives, modifications, applications and variations as may fall within the spirit and scope of the appended claims.

What is claimed is:

1. A print head unit, comprising:

an ink-jet print head having an ink supply inlet;

a first support member in which the ink-jet print head is formed;

a pressure damper for absorbing pressure variations in the ink in the ink-jet print head, the pressure damper having an ink outlet that is removably connectable to the ink supply inlet;

a second support member for supporting the pressure damper movably in a connect/disconnect direction of the ink outlet to the ink supply inlet, the second support member being removably connectable to the first support member; and a biasing element for pushing the ink outlet of the pressure damper to the ink supply inlet of the ink-jet print head.

2. A print head unit as described in claim 1, wherein the pressure damper has a seat at a back part of the ink outlet, and the biasing element pushes against the seat.

3. A print head unit as described in claim 2, wherein the second support member is a case for accommodating the pressure damper therein, and the biasing element is a spring extending between the seat and an inner wall of the case.

4. A print head unit as described in claim 3, wherein an opening for exposing the ink outlet of the pressure damper is provided in a bottom wall of the case, and an opening for exposing part of a top of the pressure damper is provided in a top wall of the case.

5. A print head unit as described in claim 3, wherein the case comprises a guide for limiting movement of the pressure damper in a direction other than the connect/disconnect direction.

6. A print head unit as described in claim 5, wherein an opening for exposing the ink outlet of the pressure damper is provided in a bottom wall of the case, and an opening for exposing part of a top of the pressure damper is provided in a top wall of the case.

7. A print head unit as described in claim 6, wherein the pressure damper further comprises a pin protruding externally from the opening provided in the top wall of the case.

8. A print head unit as described in claim 7, wherein the pressure damper has a circumferential surface between two parallel sides, and the ink supply inlet, ink outlet, and pin are formed on the circumferential surface.

9. A print head unit as described in claim 2, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

10. A print head unit as described in claim 2, wherein the second support member comprises a guide for limiting movement of the pressure damper in a direction other than the connect/disconnect direction.

11. A print head unit as described in claim 10, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

12. A print head unit as described in claim 1, wherein the second support member comprises a guide for limiting movement of the pressure damper in a direction other than the connect/disconnect direction.

13. A print head unit as described in claim 12, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

14. A print head unit as described in claim 1, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

15. A print head unit as described in claim 1, wherein the first support member holds a plurality of ink-jet print heads, and the second support member houses a plurality of pressure dampers, each corresponding to one of the ink-jet print heads.

16. A print head unit as described in claim 1, wherein the first support member is a carriage.

17. A printer, comprising:

a printing mechanism for printing to a print medium, the printing mechanism comprising a print head unit that includes an ink-jet print head having an ink supply inlet;

a first support member in which the ink-jet print head is formed;

a pressure damper for absorbing pressure variations in the ink in the ink-jet print head, the pressure damper having an ink outlet that is removably connectable to the ink supply inlet;

a second support member for supporting the pressure damper movably in a connect/disconnect direction of the ink outlet to the ink supply inlet, the second support member being removably connectable to the first support member; and a biasing element for pushing the ink outlet of the pressure damper to the ink supply inlet of the ink-jet print head.

18. A printer as described in claim 17, wherein the pressure damper has a seat at a back part of the ink outlet, and the biasing element pushes against the seat.

19. A printer as described in claim 18, wherein the second support member is a case accommodating the pressure damper therein, and the biasing element is a spring extending between the seat and an inner wall of the case.

20. A printer as described in claim 19, wherein an opening for exposing the ink outlet of the pressure damper is provided in a bottom wall of the case, and an opening for exposing part of a top of the pressure damper is provided in a top wall of the case.

21. A printer as described in claim 19, wherein the second support member comprises a guide for limiting movement of the pressure damper in a direction other than the connect/disconnect direction.

22. A printer as described in claim 21, wherein an opening for exposing the ink outlet of the pressure damper is provided in a bottom wall of the case, and an opening for exposing part of a top of the pressure damper is provided in a top wall of the case.

23. A printer as described in claim 22, wherein the pressure damper further comprises a pin protruding externally from the opening provided in the top wall of the case.

24. A printer as described in claim 23, wherein the pressure damper has a circumferential surface between two parallel sides, and the ink supply inlet, ink outlet, and pin are formed on the circumferential surface.

25. A printer as described in claim 18, wherein the second support member comprises a guide for limiting movement of the pressure damper in a direction other than the connect/disconnect direction.

26. A print head unit as described in claim 25, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

27. A printer as described in claim 18, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

28. A printer as described in claim 17, wherein the second support member comprises a guide for limiting movement of the pressure damper in a direction other than the connect/disconnect direction.

29. A printer as described in claim 28, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

30. A printer as described in claim 17, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

31. A printer as described in claim 17, wherein the first support member holds a plurality of ink-jet print heads, and the second support member houses a plurality of pressure dampers, each corresponding to one of the ink-jet print heads.

32. A print head unit, comprising:

an inkjet head having an ink inlet and being secured to a first support member;

an ink supply unit for supplying ink to the ink inlet, the ink supply unit including, a pressure damper for avoiding the ink supplied to the ink inlet from being subjected to pressure variations, the pressure damper having an ink outlet detachably connected to the ink inlet, such that it can be detached by relative movement with respect to the ink inlet in a first direction and connected by relative movement in the opposite second direction, and a second support member for supporting the pressure damper so as to be movable in the first and second directions, the second support member being detachably fixed to the first support member; and a biasing element for pushing the ink outlet of the pressure damper in the second direction to the ink inlet of the inkjet head.

33. The print head unit of claim 32, wherein the pressure damper has a seat formed on a side of the ink outlet opposite to the side connected to the ink inlet, and the biasing element pushes against the seat.

34. The print head unit of claim 32, wherein the second support member is a case accommodating the pressure damper therein and the biasing element is a spring arranged between the seat and an inner wall of the case.

35. The print head unit of claim 32, wherein the second support member comprises a guide for limiting a movement of the pressure damper in a direction other than the first and second directions.

36. The print head unit of claim 32, wherein the second support member is a case accommodating the pressure damper therein, an opening for exposing the ink outlet being provided in a bottom wall of the case, and an opening for exposing part of a top of the pressure damper is disposed in a top wall of the case.

37. The print head unit of claim 36, wherein the pressure damper further comprises a pin penetrating the opening and projecting to the outside of the case.

38. The print head unit of claim 37, wherein the pressure damper has a circumferential surface between two substantially parallel side walls, and the ink inlet, ink outlet, and pin are formed on the circumferential surface.

39. A method of making a print head unit, comprising:

providing an ink-jet print head having an ink supply inlet;

providing a first support member in which the ink-jet print head is formed;

providing a pressure damper for absorbing pressure variations in the ink in the ink-jet print head, the pressure damper having an ink outlet that is removably connectable to the ink supply inlet;

providing a second support member for supporting the pressure damper movably in a connect/disconnect direction of the ink outlet to the ink supply inlet, the second support member being removably connectable to the first support member; and providing a biasing element for pushing the ink outlet of the pressure damper to the ink supply inlet of the ink-jet print head.

40. A method of making a print head unit as described in claim 39, wherein the pressure damper is provided with a seat at a back part of the ink outlet, and the biasing element pushes against the seat.

41. A method of making a print head unit as described in claim 40, wherein the second support member is a case accommodating the pressure damper therein, and the biasing element is a spring extending between the seat and an inner wall of the case.

42. A method of making a print head unit as described in claim 41, wherein an opening for exposing the ink outlet of the pressure damper is provided in a bottom wall of the case, and an opening for exposing part of a top of the pressure damper is provided in a top wall of the case.

43. A method of making a print head unit as described in claim 41, wherein the case is provided with a guide for limiting movement of the pressure damper in a direction other than the connect/disconnect direction.

44. A method of making a print head unit as described in claim 43, wherein an opening for exposing the ink outlet of the pressure damper is provided in a bottom wall of the case, and an opening for exposing part of a top of the pressure damper is provided in a top wall of the case.

45. A method of making a print head unit as described in claim 44, wherein the pressure damper is further provided with a pin protruding externally from the opening provided in the top wall of the case.

46. A method of making a print head unit as described in claim 45, wherein the pressure damper has a circumferential surface between two parallel sides, and the ink supply inlet, ink outlet, and pin are formed on the circumferential surface.

47. A method of making a print head unit as described in claim 40, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

48. A method of making a print head unit as described in claim 40, wherein the second support member is provided with a guide for limiting movement of the pressure damper in a direction other than the connect/disconnect direction.

49. A method of making a print head unit as described in claim 48, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

50. A method of making a print head unit as described in claim 39, wherein the second support member is provided with a guide for limiting movement of the pressure damper in a direction other than the connect/disconnect direction.

51. A method of making a print head unit as described in claim 50, wherein an opening for exposing the ink outlet of the pressure damper is provided in a bottom wall of the case, and an opening for exposing part of a top of the pressure damper is provided in a top wall of the case.

52. A method of making a print head unit as described in claim 39, wherein the second support member is a case accommodating the pressure damper therein, an opening for exposing the ink outlet of the pressure damper is provided in a bottom wall of the case, and an opening for exposing part of a top of the pressure damper is provided in a top wall of the case.

53. A method of making a print head unit as described in claim 39, wherein the first support member holds a plurality of ink-jet print heads, and the second support member houses a plurality of pressure dampers, each corresponding to one of the ink-jet print heads.

54. A method of making a print head unit as described in claim 39, wherein the first support member is a carriage.

* * * * *

UNITED STATES PATENT AND TRADEMARK OFFICE

CERTIFICATE OF CORRECTION

PATENT NO. : 6,460,986 B2
DATED : October 8, 2002
INVENTOR(S) : Toshiyuki Sasaki It is certified that error appears in the above-identified patent and that said Letters Patent is hereby corrected as shown below:

Title page,
Item [56], References Cited,
U.S. PATENT DOCUMENTS, add -- 5,030,973 7/1991 --,
FOREIGN PATENT DOCUMENTS, add -- 5-201016 8/1993 -- and -- 10-193646 7/1998 --

Signed and Sealed this

Twenty-fifth Day of February, 2003

JAMES E. ROGAN
*Director of the United States Patent and Trademark Office*